US011536504B2

(12) United States Patent
Bahel et al.

(10) Patent No.: US 11,536,504 B2
(45) Date of Patent: Dec. 27, 2022

(54) ICE MACHINE INCLUDING VAPOR-COMPRESSION SYSTEM

(71) Applicant: Emerson Climate Technologies, Inc., Sidney, OH (US)

(72) Inventors: Vijay O. Bahel, Sidney, OH (US); Natarajan Rajendran, Centerville, OH (US); Kurt J. Knapke, Minster, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 108 days.

(21) Appl. No.: 16/686,759

(22) Filed: Nov. 18, 2019

(65) Prior Publication Data

US 2020/0080760 A1 Mar. 12, 2020

Related U.S. Application Data

(62) Division of application No. 15/375,614, filed on Dec. 12, 2016, now abandoned.

(Continued)

(51) Int. Cl.

| | |
|---|---|
| ***F25C 1/22*** | (2018.01) |
| ***F25C 5/10*** | (2006.01) |
| ***F25C 1/04*** | (2018.01) |

(52) U.S. Cl.

CPC ..... *F25C 1/22* (2013.01); *F25C 1/04* (2013.01); *F25C 5/10* (2013.01); *F25B 2500/19* (2013.01);

(Continued)

(58) Field of Classification Search

CPC .... F25C 5/10; F25C 2400/14; F25C 2500/04; F25C 2700/14; F25B 2500/19; F25B 2600/025

See application file for complete search history.

(56) References Cited

U.S. PATENT DOCUMENTS 3,430,452 A 3/1969 Dedricks et al.
4,791,792 A 12/1988 Naruse et al.

(Continued)

FOREIGN PATENT DOCUMENTS

CN 101403540 A 4/2009
CN 101929773 A 12/2010

(Continued)

OTHER PUBLICATIONS

AHRI Standard 540—2015 Standard for Performance Rating of Positive Displacement Refrigerant Compressors and Compressor Units, Air-Conditioning, Heating, & Refrigeration Institute, Arlington, VA (2015).

(Continued)

*Primary Examiner* — Elizabeth J Martin

(74) *Attorney, Agent, or Firm* — Harness, Dickey & Pierce, P.L.C.

(57) ABSTRACT

A method may include selecting a first set of values for a first set of parameters of one or more hardware components of an ice-making machine; identifying a water temperature at a water inlet of the ice-making machine; identifying an ambient air temperature surrounding the ice-making machine; calculating a second set of parameters of the ice-making machine based on at least a portion of the first set of values, the water temperature and the ambient temperature, the second set of parameters corresponding to operation of the ice-making machine in a freeze mode in which liquid water is cooled by an evaporator; and calculating a third set of parameters based on at least a portion of the first set of values, the water temperature and the ambient temperature, the third set of parameters corresponding to operation of the ice-making machine in a harvest mode.

12 Claims, 4 Drawing Sheets

Related U.S. Application Data

(60) Provisional application No. 62/332,010, filed on May 5, 2016, provisional application No. 62/268,249, filed on Dec. 16, 2015.

(52) U.S. Cl.
CPC ..... *F25B 2600/025* (2013.01); *F25C 2400/14* (2013.01); *F25C 2500/04* (2013.01); *F25C 2600/04* (2013.01); *F25C 2700/14* (2013.01)

(56) References Cited

U.S. PATENT DOCUMENTS

| | | | | |
|---|---|---|---|---|
| 6,205,807 | B1 | 3/2001 | Broadbent | |
| 6,647,739 | B1 | 11/2003 | Kim et al. | |
| 6,681,580 | B2 | 1/2004 | Shedivy et al. | |
| 7,606,683 | B2 * | 10/2009 | Bahel | G06F 30/20 703/1 |
| 7,908,126 | B2 * | 3/2011 | Bahel | G06F 30/20 703/6 |
| 9,910,449 | B2 * | 3/2018 | Matsuoka | G05B 15/02 |
| 10,641,535 | B2 | 5/2020 | Murgham et al. | |
| 2002/0095944 | A1 | 7/2002 | Stensrud et al. | |
| 2004/0244398 | A1 | 12/2004 | Radermacher et al. | |
| 2005/0028549 | A1 * | 2/2005 | Kuroyanagi | F25C 1/147 62/352 |
| 2006/0277928 | A1 * | 12/2006 | McDougal | F25C 5/187 62/66 |
| 2009/0001866 | A1 | 1/2009 | Kaga et al. | |
| 2009/0288445 | A1 | 11/2009 | Anikhindi et al. | |
| 2010/0147005 | A1 | 6/2010 | Watson et al. | |
| 2010/0218519 | A1 | 9/2010 | Hall et al. | |
| 2011/0082651 | A1 * | 4/2011 | Mowris | F24F 11/30 702/45 |
| 2011/0314842 | A1 | 12/2011 | Herrera et al. | |
| 2011/0314848 | A1 | 12/2011 | Tanaka | |
| 2012/0174607 | A1 * | 7/2012 | Cur | F25B 25/00 62/132 |
| 2012/0222434 | A1 | 9/2012 | Gist et al. | |
| 2014/0209125 | A1 | 7/2014 | Broadbent | |
| 2019/0285327 | A1 | 9/2019 | Murgham et al. | |

FOREIGN PATENT DOCUMENTS

| | | | |
|---|---|---|---|
| CN | 102066856 | A | 5/2011 |
| CN | 102345953 | A | 2/2012 |
| EP | 0708300 | A1 | 4/1996 |
| JP | H03034576 | U | 4/1991 |
| JP | 2006023068 | A | 1/2006 |
| JP | 2009145017 | A | 7/2009 |
| KR | 2019890016569 | U | 8/1989 |
| KR | 101461802 | B1 | 11/2014 |

OTHER PUBLICATIONS

ARI Standard 810—2007 Standard for Performance Rating of Automatic Commercial Ice-Makers, Air-Conditioning and Refrigeration Institute, Arlington, VA (2007).

Arora, A. et al., "Theoretical Analysis of a Vapour Compression Refrigeration System with R502, R404A and R507A." International Journal of Refrigeration, 31(6), pp. 998-1005 (2008).

Bahel, V. et al., "Using Simulation Model to Reduce System Design Time and Cost." Proceedings of the International Refrigeration and Air Conditioning Conference, Paper 1409 (2014).

Bendapudi, S. et al., "A Comparison of Moving-Boundary and Finite-Volume Formulation in Centrifugal Chillers." International Journal of Refrigeration, 31(8), pp. 1437-1452 (2008).

Chi, J. et al., "A Simulation of the Transient Performance of a Heat Pump." International Journal of Refrigeration, 5(3), pp. 176-184 (1982).

Dabiri, A. E. et al., "A Compressor Simulation Model with Corrections for the Level of Suction Gas Superheat." ASHRAE Transactions, 87(2), pp. 771-782 (1981).

Domanski, P. et al., Computer Modeling of the Vapor Compression Cycle with Constant Flow Area Expansion Device, NBS Build Science Series 155, National Institute of Standards and Technology, Gaithersburg, MD (1983).

Fisher, S. K. et al., "Loss and Efficiency-Based Compressor Model." The Oak Ridge Heat Pump Models: Steady-State Computer Design Model for Air-to-Air Heat Pumps, ORNL/CON-80/R1, Oak Ridge National Laboratory, Oak Ridge, TN, pp. 26-36 (1983).

Ge, Y. T. et al., "Performance Evaluation of Air-Cooled Condensers Using Pure and Mixed Refrigerants by Four-Section Lumped Modeling Methods." Applied Thermal Engineering, 25(10), pp. 1549-1564 (2005).

Hoffenbecker, N. et al., "Hot Gas Defrost Model Development and Validation." International Journal of Refrigeration, 28(2), pp. 605-615 (2005).

James, K. A. et al., "Transient Analysis of Thermostatic Expansion Valves for Refrigeration System Evaporators Using Mathematical Models." Transactions of the Institute of Measurement and Control, 9(4), pp. 198-205 (1987).

Laughman, C. et al., "Fast Refrigerant Property Calculations Using Interpolation-Based Methods." Proceedings of the International Refrigeration and Air Conditioning Conference, Paper 1344 (2012).

Li, B. et al., "A Dynamic Model of a Vapor Compression Cycle with Shut-Down and Start-Up Operations." International Journal of Refrigeration, 33(3), pp. 538-552 (2010).

MacArthur, J. W., "Transient Heat Pump Behaviour: A Theoretical Investigation." International Journal of Refrigeration, 7(2), pp. 123-132 (1984).

Mathworks, SimScape™ Users Guide, The Mathworks Inc., Natick, MA (2015).

Qiao, H. et al., "Comparison of Equation-based and Non-equation-based Approaches for Transient Modeling of a Vapor Compression Cycle." Proceedings of the International Refrigeration and Air Conditioning Conference, Paper 1205 (2012).

Varone, A., "Appendix 5A, Energy Modeling." Program FREEZE for Ice Machine Product Development, U.S. Department of Energy, pp. 5A1-5A8 (1995).

Wang, C. C. et al., "A Comparative Study of Compact Enhanced Fin-and-Tube Heat Exchangers." International Journal of Heat and Mass Transfer, 44(18), pp. 3565-3573 (2001).

Wang, C.C. et al., "A Heat Transfer and Friction Correlation for Wavy Fin-and-Tube Heat Exchangers." International Journal of Heat and Mass Transfer, 42(10), pp. 1919-1924 (1999).

Wang, C. C. et al., "Heat Transfer and Friction Characteristics of Plain Fin-and-Tube Heat Exchangers, Part I: New Experimental Data." International Journal of Heat and Mass Transfer, 43(15), pp. 2681-2691 (2000).

Wang, C. C. et al., "Heat Transfer and Friction Correlation for Compact Louvered Fin-and-Tube Heat Exchangers." International Journal of Heat and Mass Transfer, 42(11), pp. 1945-1956 (1999).

Westphalen, D. et al., "Ice Machines." Energy Savings Potential for Commercial Refrigeration Equipment, U.S. Department of Energy, pp. 39-49 (1996).

Restriction Requirement regarding U.S. Appl. No. 15/375,614, dated Sep. 6, 2018.

Office Action regarding Chinese Patent Application No. 201611159751.3, dated Dec. 25, 2018. Translation provided by Unitalen Attorneys at Law.

Office Action regarding U.S. Appl. No. 15/375,614, dated Jan. 24, 2019.

International Search Report regarding International Application No. PCT/US2019/019228, dated Jun. 3, 2019.

Written Opinion of the International Searching Authority regarding International Application No. PCT/US2019/019228, dated Jun. 3, 2019.

Office Action regarding Chinese Patent Application No. 201611159751.3, dated Aug. 5, 2019. Translation provided by Unitalen Attorneys at Law.

Office Action regarding U.S. Appl. No. 15/375,614, dated Aug. 19, 2019.

Office Action regarding U.S. Appl. No. 15/924,824, dated Aug. 29, 2019.

(56) References Cited

OTHER PUBLICATIONS

Office Action regarding Chinese Patent Application No. 201611159751.3, dated Nov. 7, 2019. Translation provided by Unitalen Attorneys at Law.
Notice of Allowance regarding U.S. Appl. No. 15/924,824, dated Jan. 2, 2020.

* cited by examiner

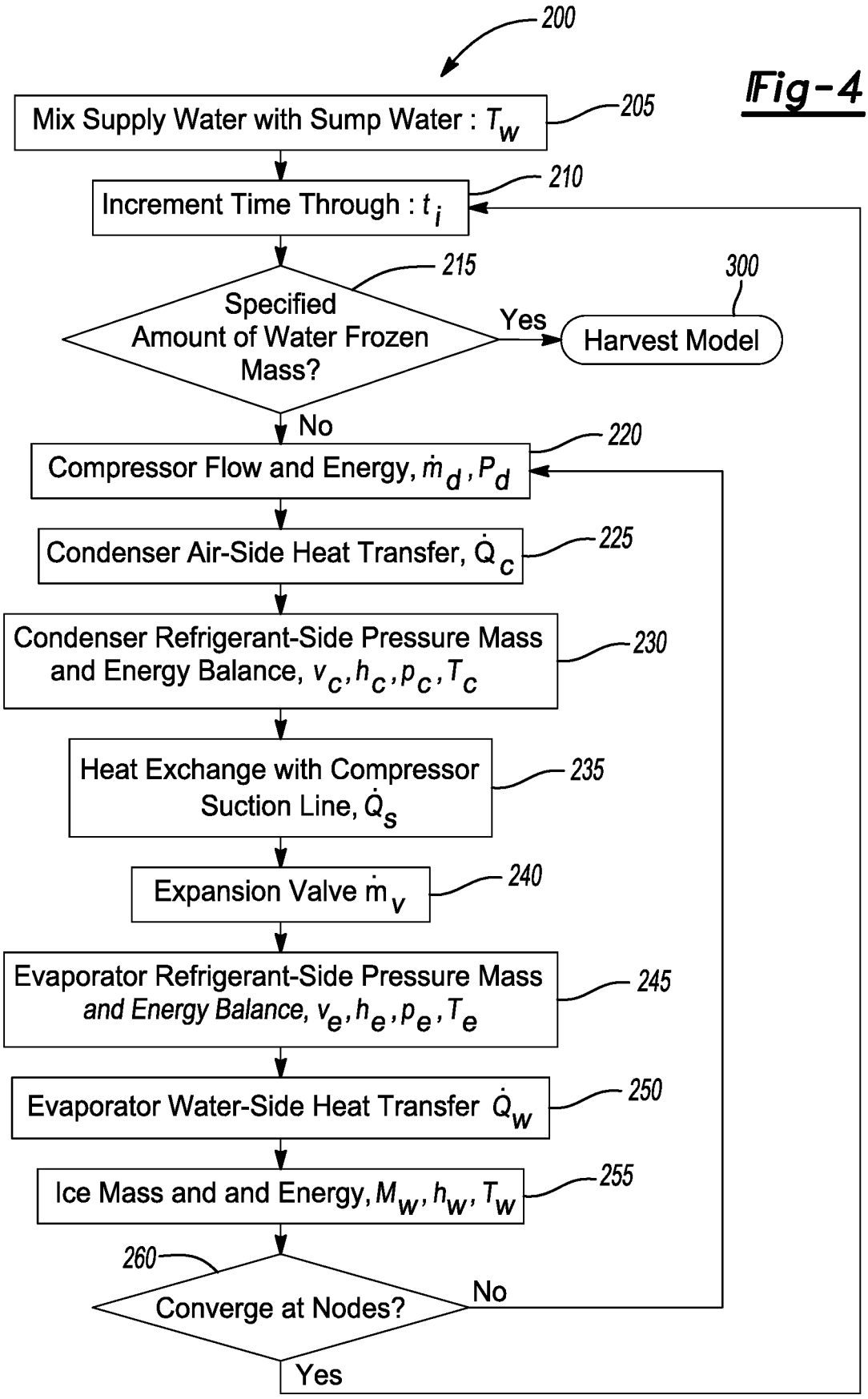
200
Fig-4
Mix Supply Water with Sump Water : $T_w$
205
Increment Time Through : $t_i$
210
Specified Amount of Water Frozen Mass?
215
Yes
Harvest Model
300
No
Compressor Flow and Energy, $\dot{m}_d, P_d$
220
Condenser Air-Side Heat Transfer, $\dot{Q}_c$
225
Condenser Refrigerant-Side Pressure Mass and Energy Balance, $v_c, h_c, p_c, T_c$
230
Heat Exchange with Compressor Suction Line, $\dot{Q}_s$
235
Expansion Valve $\dot{m}_v$
240
Evaporator Refrigerant-Side Pressure Mass and Energy Balance, $v_e, h_e, p_e, T_e$
245
Evaporator Water-Side Heat Transfer $\dot{Q}_w$
250
Ice Mass and and Energy, $M_w, h_w, T_w$
255
260
Converge at Nodes?
No
Yes

ICE MACHINE INCLUDING VAPOR-COMPRESSION SYSTEM

CROSS-REFERENCE TO RELATED APPLICATIONS

This application is a divisional of U.S. application Ser. No. 15/375,614, filed on Dec. 12, 2016, which claims the benefit of U.S. Provisional Application No. 62/332,010, filed on May 5, 2016 and U.S. Provisional Application No. 62/268,249, filed on Dec. 16, 2015. The entire disclosures of each of the above applications are incorporated herein by reference.

FIELD

The present disclosure relates to an ice machine (e.g., an automatic commercial ice machine) including a vapor-compression system.

BACKGROUND

This section provides background information related to the present disclosure and is not necessarily prior art.

Automatic commercial ice-making machines produce batches of ice cubes at regular intervals. Such ice machines are commonly used in food service, food preservation, hotel and health service industries. Ice machines typically include a vapor-compression system that is operable in a freeze mode and a harvest mode. In the freeze mode, the vapor-compression system freezes water in a grid plate (i.e., an ice tray) formed on an evaporator of the vapor-compression system. In the harvest mode, the vapor-compression system melts a small amount of the ice in the ice tray so that the ice cubes can be easily ejected from the ice tray.

There is a demand in the ice machine industry to provide ice machines that consume less energy while maintaining or increasing ice production levels. The present disclosure provides an ice machine and a simulation model that allows ice machine designers and engineers to quickly evaluate how changing one or more system design options and parameters can impact the energy consumption and ice production of the ice machine.

SUMMARY

This section provides a general summary of the disclosure, and is not a comprehensive disclosure of its full scope or all of its features.

In one form, the present disclosure provides an ice machine that may include a compressor, a first heat exchanger, an expansion device, an evaporator, an ice tray, and a water pump. The first heat exchanger may receive compressed working fluid from the compressor. The expansion device may receive working fluid from the first heat exchanger. The evaporator may receive working fluid from the expansion device. The ice tray may be in a heat transfer relationship with the evaporator. The ice tray may include a plurality of ice molds. The water pump may be in fluid communication with the ice molds and may be configured to pump water from a water source to the ice molds. Structural characteristics of at least one of the compressor, the first heat exchanger, the expansion device, and the evaporator are specified based on output from a processor. The processor may receive a first set of values for a first set of parameters of the compressor, the first heat exchanger, the expansion device, and the evaporator. The processor may calculate a second set of parameters of the ice machine based on at least a portion of the first set of values, a water temperature and an ambient air temperature. The second set of parameters may correspond to operation of the ice machine in a freeze mode in which liquid water is cooled in the ice molds by the evaporator. The processor may calculate a third set of parameters of the ice machine based on at least a portion of the first set of values, the water temperature and the ambient temperature. The third set of parameters may correspond to operation of the ice-making machine in a harvest mode during which a predetermined amount of ice is melted until the ice is removed from the ice molds.

In some configurations, the ice machine includes a water sump disposed within the evaporator and in fluid communication with the water pump.

In some configurations, the ice machine includes a second heat exchanger including a first coil and a second coil. The first coil may receive working fluid from the first heat exchanger and may be disposed upstream of the expansion device. The second coil may receive working fluid from the evaporator and may be disposed upstream of the compressor.

In another form, the present disclosure provides a method that may include selecting a first set of values for a first set of parameters of one or more hardware components of an ice-making machine; identifying a water temperature at a water inlet of the ice-making machine; identifying an ambient air temperature surrounding the ice-making machine; calculating a second set of parameters of the ice-making machine based on at least a portion of the first set of values, the water temperature and the ambient temperature, the second set of parameters corresponding to operation of the ice-making machine in a freeze mode in which liquid water is cooled by an evaporator; and calculating a third set of parameters of the ice-making machine based on at least a portion of the first set of values, the water temperature and the ambient temperature, the third set of parameters corresponding to operation of the ice-making machine in a harvest mode during which a predetermined amount of ice is melted until the ice is removed from the evaporator.

In some configurations, the method includes selecting a second set of values for the first set of parameters of the one or more hardware components; calculating the second set of parameters of the ice-making machine based on at least a portion of the second set of values; calculating the third set of parameters of the ice-making machine based on at least a portion of the second set of values; and comparing results of the calculations of the second and third sets of parameters based on the first values with the results of the calculations of the second and third sets of parameters based on the second values.

In some configurations, the results include energy consumption of the ice-making machine and ice production of the ice-making machine.

In some configurations, the method includes designing a vapor-compression system based on the comparison of the results.

In some configurations, designing the vapor-compression system includes selecting a compressor based on the comparison of the results.

In some configurations, the first set of parameters include compressor capacity, compressor efficiency, and/or compressor motor speed.

In some configurations, the first set of parameters include geometric parameters of the condenser and evaporator.

In some configurations, the first set of parameters include initial evaporator and condenser pressures at a startup of the ice-making machine.

In some configurations, the first set of parameters includes an air flow rate of a condenser fan.

In some configurations, the method includes displaying values of the second and third sets of parameters.

In some configurations, the second and third sets of parameters include energy consumption of the ice-making machine and ice production of the ice-making machine.

In some configurations, the second set of parameters includes heat transfer between first and second conduits of a heat exchanger, the first conduit containing condensed refrigerant upstream of an expansion device, the second conduit receiving refrigerant downstream of the evaporator and upstream of a suction inlet of a compressor.

In some configurations, the second set of parameters includes a flow area of an expansion device.

In some configurations, the third set of parameters includes a flow area of a bypass control valve.

In some configurations, calculating the second and third sets of parameters includes using an implicit solver to solving sets of equations to satisfy Kirchhoff's first and second laws at nodes of a vapor-compression system of the ice-making machine.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 4 is a flowchart generally outlining a freeze model of the simulation model.

Corresponding reference numerals indicate corresponding parts throughout the several views of the drawings.

DETAILED DESCRIPTION

Figure 1:
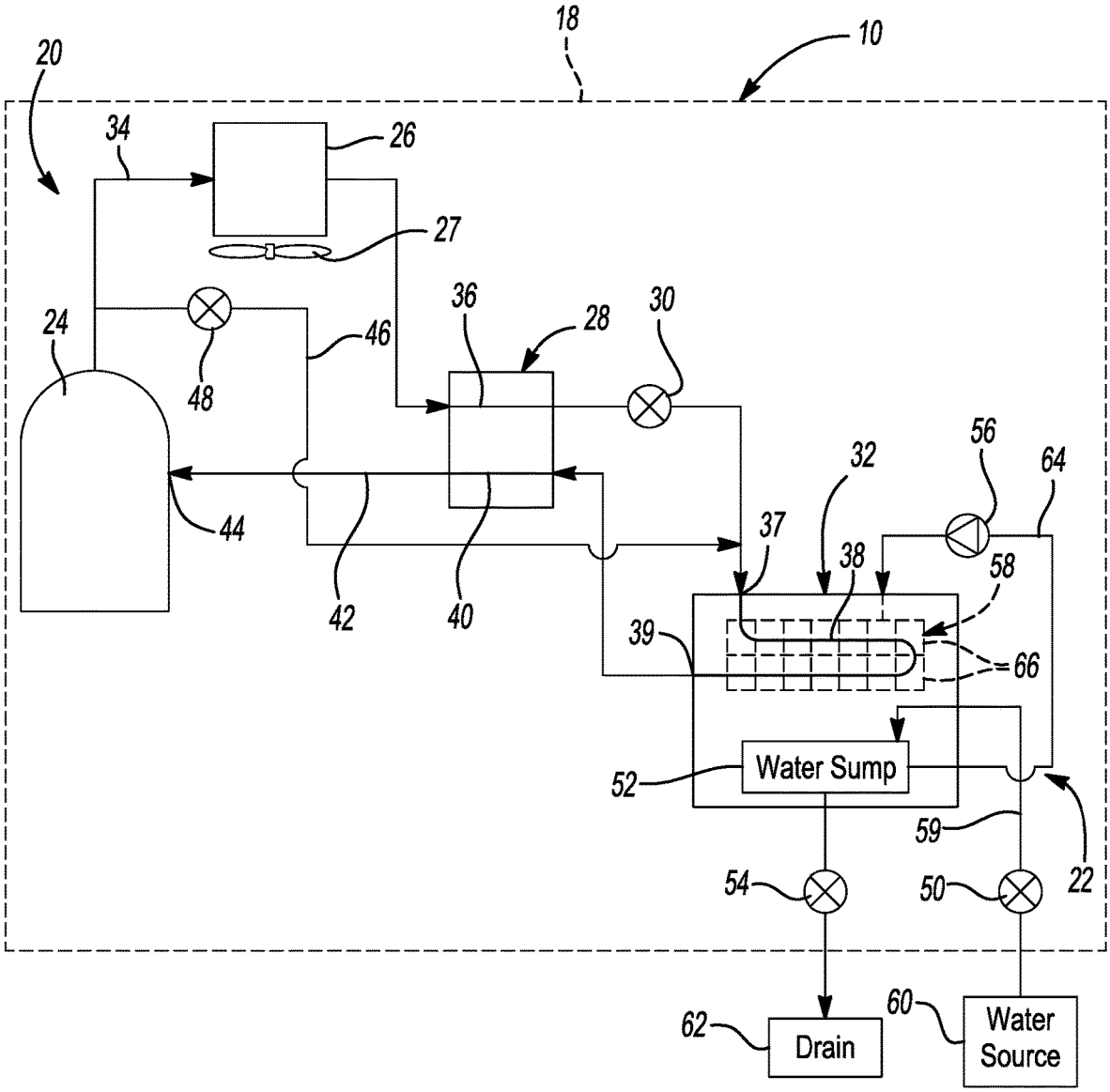
FIG. 1 is a schematic representation of an ice maker.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present disclosure provides a simulation model of an ice-making machine such as an automatic commercial ice maker 10 (shown schematically in FIG. 1), for example. As will be described in more detail below, the simulation model enables prediction of component conditions, loads under different operating environments, and assessment of system design changes. The simulation model simulates transient operation of the ice maker 10 based, in part, on generalized correlations. The simulation model determines time-varying changes in properties of the ice maker 10 and aggregates performance results as a function of machine capacity and environmental conditions. The simulation model can conduct rapid "what if" analyses enabling ice maker designers and engineers to quickly evaluate the impact of a variety of system design options including, for example, heat exchanger size, size and shape of finned surfaces, air flow rate, water flow rate, ambient air temperature, inlet water temperature, compressor capacity and/or efficiency for freeze and harvest cycles of the ice maker 10, refrigerants, suction-line heat exchanger properties, and/or expansion valve properties.

Figure 2:
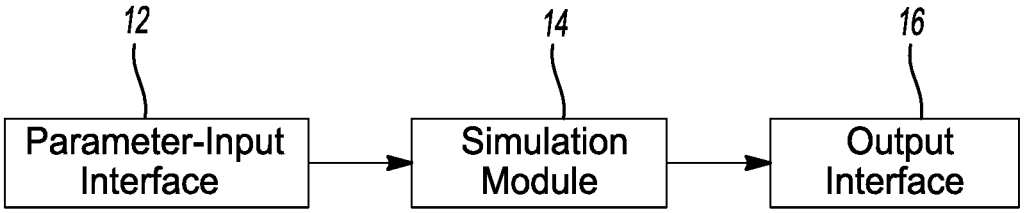
FIG. 2 is a schematic representation of a simulation module in communication with input and output interfaces.

As shown in FIG. 2, the simulation model may include a parameter-input interface 12 (e.g., a computer keyboard and/or mouse), a simulation module 14 (e.g., a processor), and an output interface 16 (e.g., a computer monitor and/or printout). A user of the simulation model may input a plurality of actual or hypothetical system and environmental parameters into the parameter-input interface 12. The simulation module 14 may conduct the above-mentioned "what if" analyses based on the parameters input by the user. The output interface 16 may transmit and/or display the results of the analyses conducted by the simulation module 14 to provide the user with a model of the impact of a variety of system design options.

Referring now to FIG. 1, an example ice maker 10 will be described in detail. The ice maker 10 includes a cabinet 18 housing a vapor-compression system 20 and a water-handling system 22. While not specifically shown in the figures, the cabinet 18 may include an ice-cube-storage bin that holds ice cubes that have been harvested during operation of the ice maker 10. The ice-cube-storage bin may include a door that a user can open to access the ice cubes within the bin.

The vapor-compression system 20 may include a compressor 24, a first heat exchanger 26 (e.g., a condenser or gas cooler), a second heat exchanger 28 (e.g., a sub-cooler or suction-line heat exchanger), an expansion device 30 (e.g., an electronic or thermostatic expansion valve, a fixed orifice or capillary tube), and a third heat exchanger 32 (e.g., an evaporator). The compressor 24 can be any suitable type of compressor, such as a scroll, reciprocating or rotary, for example. The compressor 24 may compress a working fluid (e.g., a refrigerant) from a suction pressure to a discharge pressure.

A discharge line 34 may fluidly connect the compressor 24 with the first heat exchanger 26. A fan 27 may force ambient air across fins (not shown) of the first heat exchanger 26 to cool the working fluid flowing through the first heat exchanger 26. The first heat exchanger 26 may also be fluidly connected with a first coil 36 of the second heat exchanger 28.

The expansion device 30 is fluidly connected with the first coil 36 and an evaporator coil 38 of the third heat exchanger 32 and is disposed between an outlet of the first coil 36 and an inlet 37 of the evaporator coil 38. A second coil 40 of the second heat exchanger 28 may be fluidly connected with an outlet 39 of the evaporator coil 38. A suction line 42 fluidly connects the second coil 40 with a suction inlet 44 of the compressor 24.

A bypass line 46 may extend from the discharge line 34 to the inlet 37 of the evaporator coil 38. A bypass control valve 48 may be disposed along the bypass line 46 and may control fluid flow through the bypass line 46.

The water-handling system 22 may include a water-inlet valve 50, a water sump 52, a sump purge valve 54, a water pump 56 and an ice tray 58. The water-inlet valve 50 may be disposed on a water-supply line 59 fluidly connected to a water source 60 (e.g., water pipes of a building in which the ice maker 10 is installed). The water-inlet valve 50 may control a flow of water through the water-supply line 59 from the water source 60 to the water sump 52. The sump purge valve 54 may be fluidly connected to the water sump 52 and a drain 62 (e.g., drainage pipes of the building in which the ice maker 10 is installed) and may control a flow of water from the water sump 52 to the drain 62. The sump purge valve 54 can be selectively opened to purge some or all of the water from the water sump 52.

The water pump 56 may be disposed along a water-fill line 64 fluidly connected to the water sump 52 and the ice tray 58. The water pump 56 may selectively pump water through the water-fill line 64 from the water sump 52 to the ice tray 58. The ice tray 58 may include a plurality of molds 66 in which water may freeze to form ice cubes. The ice tray 58 may be mounted on, integrally formed with, or otherwise situated to be in a heat transfer relationship with the evaporator coil 38 such that heat can be exchanged between liquid water or ice in the ice tray 58 and working fluid in the evaporator coil 38.

With continued reference to FIG. 1, operation of the ice maker 10 will be described in detail. The ice maker 10 is operable in a freeze mode in which liquid water in the ice tray 58 is cooled to or beyond its freezing point and in a harvest mode in which ice cubes in the ice tray 58 are heated to allow the ice cubes to be ejected from the ice tray 58. A control module (not shown) may control operation of the compressor 24, the expansion device 30, the bypass control valve 48, the water-inlet valve 50, the sump purge valve 54, and the water pump 56.

When the freeze mode is initiated, the water pump 56 pumps water from the sump 52 into the molds 66 of the ice tray 58. The water-inlet valve 50 may open and close as needed to provide an adequate amount of water to the water sump 52.

During operation in the freeze mode, the bypass control valve 48 is closed to prevent the flow of hot discharge-pressure working fluid through the bypass line 46. Therefore, in the freeze mode, the discharge-pressure working fluid discharged from the compressor 24 may flow through the discharge line 34 to the first heat exchanger 26.

In the first heat exchanger 26, heat from the working fluid may be transferred to ambient air. From the first heat exchanger 26, the working fluid may flow into the first coil 36 of the second heat exchanger 28. Heat from the working fluid in the first coil 36 may be absorbed by suction-pressure working fluid in the second coil 40 of the second heat exchanger 28, thereby further cooling the working fluid in the first coil 36. From the first coil 36, the working fluid may flow through the expansion device 30 before flowing into the evaporator coil 38. Cold working fluid in the evaporator coil 38 absorbs heat from the water in the molds 66 of the ice tray 58. After exiting the evaporator coil 38, the working fluid may flow through the second coil 40 of the second heat exchanger 28 and then flow back to the compressor 24 (via suction inlet 44).

Once the water in the ice tray 58 is sufficiently frozen (i.e., a predetermined ice batch weight has been reached, as determined based on any of a sump water level, compressor suction pressure, thickness of ice on the ice tray 58, etc.), the ice maker 10 may be switched to the harvest mode. In the harvest mode, the bypass control valve 48 is open to allow hot discharge-pressure working fluid exiting the compressor 24 to flow through the bypass line 46 and directly into the evaporator coil 38. Therefore, in the harvest mode, hot working fluid in the evaporator coil 38 heats the ice in the ice tray 58 to melt a small amount (e.g., 5-10%) of ice in each mold 66, thereby allowing the ice cubes in the ice tray 58 to fall out of the ice tray 58 by gravity (or allowing the ice cubes to be forced out of the ice tray 58 by other means) into the ice-cube-storage bin of the ice maker 10.

During the operation in harvest mode, water in the water sump 52 may be purged by opening the sump purge valve 54. During the purge of the water sump 52, fresh water from the water source 60 may be flushed through the water-handling system 22 and drained out of the water sump 52 (via the purge valve 54) to flush any impurities out of the water-handing system 22. Once the ice cubes fall out of the ice tray 58 and into the ice-cube-storage bin (as determined by evaporator temperature and/or time, for example), the water sump 52 may be filled (e.g., to a water level that is 10-40% more water than is needed to make a batch of ice cubes) and the ice maker 10 can switch back to the freeze mode.

While the ice maker 10 is described above as making ice cubes, it will be appreciated that the molds 66 of the ice tray 58 can be configured to make ice in any shape including, for example, cubes, rectangular prisms, cylinders, nuggets, flakes or crescents.

Figure 3:
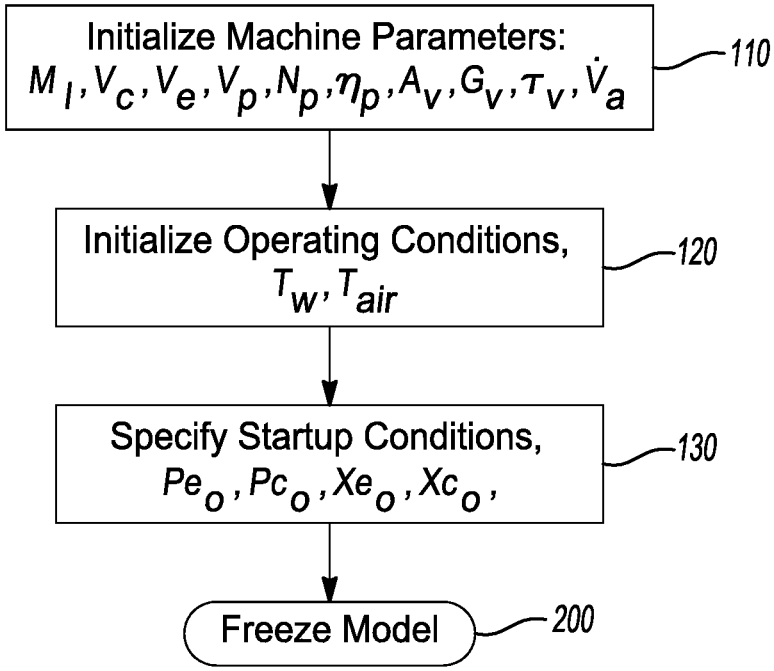
FIG. 3 is a flowchart depicting an initialization process of a simulation model.

Referring now to FIGS. 2-5, operation of the simulation model will be described in detail. As shown in FIG. 3, the simulation may begin with various parameters being input by the user into the parameter-input interface 12 (FIG. 2). At block 110, machine parameters may be input. Such machine parameters may include (i) a specified mass of ice M1 to be formed within the ice tray 58, (ii) physical geometric parameters Vc of the first heat exchanger 26 (condenser), (iii) physical geometric parameters Ve of the third heat exchanger 32 (evaporator), (iv) physical geometric parameters Vp of the compression mechanism of the compressor 24 (e.g., displacement of the compression mechanism), (v) speed w of the motor of the compressor 24, (vi) efficiency n of the compressor 24 (e.g., volumetric and/or isentropic efficiencies), (vii) throttling area Av of the expansion device 30, (viii) gain Gv of the expansion device 30, (ix) time constant τV of the expansion device 30, (x) volumetric flow rate Va of air forced over the first heat exchanger 26 by the fan 27, and (xi) refrigerant type.

At block 120, operating conditions may be input by the user. The operating conditions may include a temperature Tw of the water supplied to the water sump 52 via the water-supply line 59 and an temperature Tair of the ambient air forced over the first heat exchanger 26 by the fan 27. At block 130, startup conditions may be input by the user. The startup conditions may include (i) an initial startup evaporator pressure pe0, (ii) an initial startup condenser pressure pc0, (iii) an initial working fluid quality xe0 (i.e., a ratio of vapor-to-liquid working fluid) at the evaporator, and an initial working fluid quality xc0 (i.e., a ratio of vapor-to-liquid working fluid) at the condenser.

Figure 5:
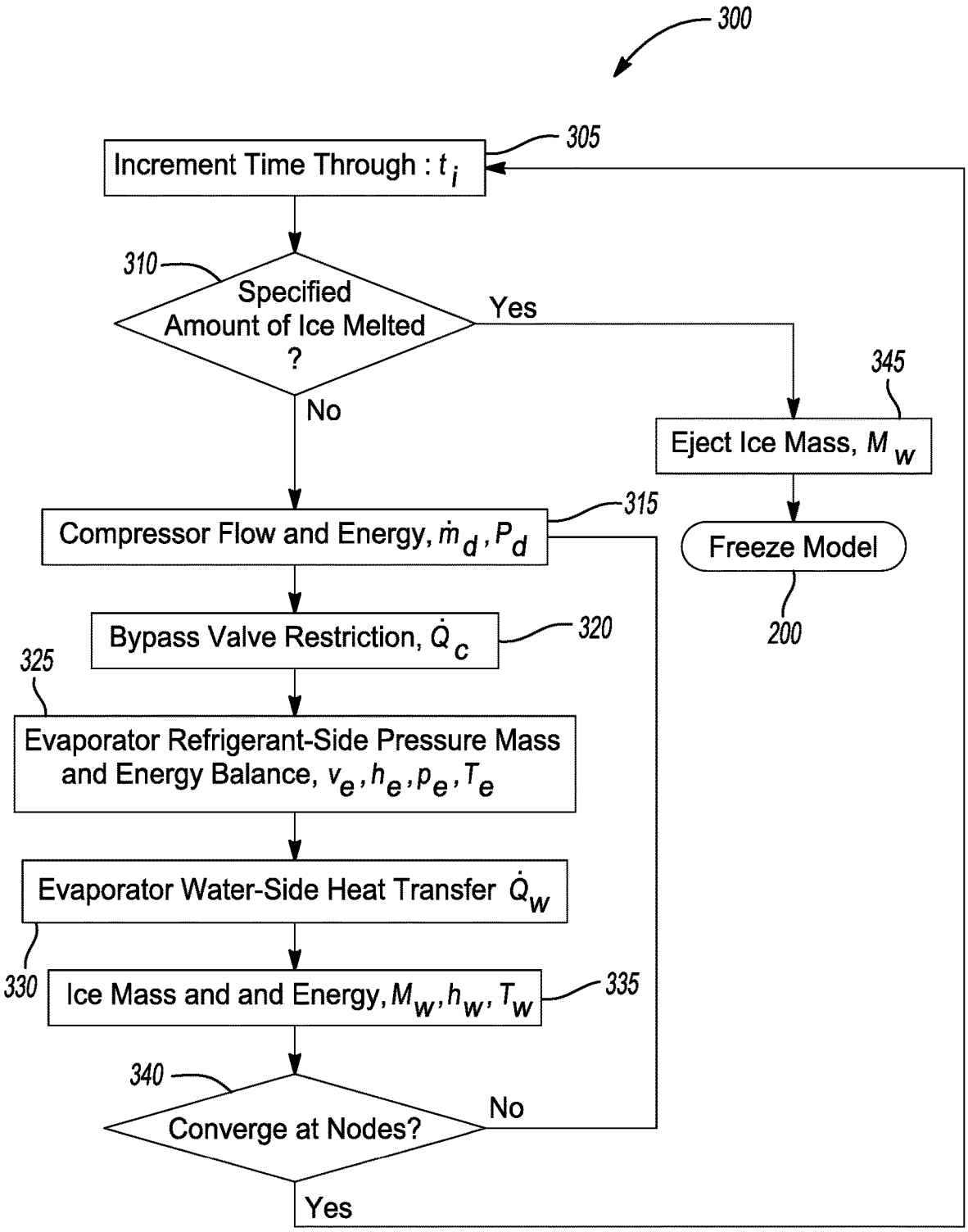
FIG. 5 is a flowchart generally outlining a harvest model of the simulation model.

After the above parameters are input into the parameter-input interface 12, the parameters are used by the simulation module 14 to run a freeze model 200 (i.e., a model of the freeze mode of the ice maker 10; outlined in FIG. 4) and a harvest model 300 (i.e., a model of the harvest mode of the ice maker 10; outlined in FIG. 5). The simulation module 14 may run implicit routines using an implicit solver (acausal modeling) system such as SimScape, Simulink®, Modelica®, LabVIEW, etc. to solve sets of overall algebraic and differential equations as needed such that Kirchhoff's first and second laws are satisfied at the nodes where components of the ice maker 10 (i.e., components of the vapor-compression system 20 and water-handling system 22) are connected. That is, through-variables (e.g., mass flow rate and heat flow rate) should sum to zero at the nodes and the across-variables (e.g., pressure and enthalpy) at the nodes should be equal.

Referring now to FIG. 4, general steps of the freeze model 200 will be described. As indicated at block 205, the freeze mode of the ice maker 10 may begin with supply water (e.g., from the water source 60) at the temperature Tw is mixed with any remaining water in the water sump 52. Block 210 increments through time (e.g., time during which the vapor-compression system 20 is operating in the freeze mode).

At block 215, the simulation module 14 determines whether a specified amount of water has been frozen in the ice tray 58 (e.g., based on elapsed time, evaporator temperature, etc.). If the specified amount of water has been frozen, then the simulation module 14 switches to the harvest model 300 (FIG. 5). If the specified amount of water has not been frozen, then the simulation module 14 proceeds to determine various system parameters (at blocks 220-255) using the implicit routines of the implicit solver system to solve sets of overall algebraic and differential equations as needed to satisfy Kirchhoff's first and second laws at the nodes.

Block 220 represents equations for compressor parameters used by the implicit solver routines. For example, a mass flow rate $\dot{m}d$ of working fluid delivered by the compressor 24 to the other components of the vapor-compression system 20 can be determined from the following equation:

$$\dot{m}_d = \eta_v \omega \rho_{cs} V_d,$$

where $\eta_v$ is volumetric efficiency of the compressor 24, ω is the compressor motor speed, $\rho_{cs}$ is the compressor suction-gas density, and $V_d$ is the displacement of the compression mechanism.

A polytropic approach can be used to determine power W consumed by the compressor 24. That is, the power W can be determined from the following equation:

$$\dot{W}k = [(k-1)/k]\eta_d \omega V_d p_e \left(1 - \frac{p_c}{p_e}\right)^{(k-1)/k},$$

where k is a polytropic exponent, $\eta_d$ is compressor efficiency, w is the compressor motor speed, $V_d$ is the displacement of the compression mechanism, $p_e$ is evaporator pressure, and $p_c$ is condenser pressure.

Alternatively, power W consumed by the compressor 24 can be determined using the following equation:

$$\dot{W} = C_1 + C_2 T_e + C_3 T_c + C_4 T_e^2 + C_5 T_e T_c + C_6 T_c^2 + C_7 T_e^3 + C_8 T_e^2 T_c + C_9 T_e T_c^2 + C_{10} T_c^3,$$

where $C_1$-$C_{10}$ are rating coefficients for a particular compressor (published by compressor manufacturers), $T_e$ is evaporator saturation temperature, and $T_c$ is condenser saturation temperature.

An energy balance on the vapor working fluid in the compressor discharge chamber can be used to determine a temperature of the working fluid $T_d$ exiting the compressor 24. An empirical compressor shell loss factor $f_q$ can be used to compensate for heat transfer through the compressor shell wall to the ambient air.

Blocks 225 and 230 represent equations for air-side and refrigerant-side condenser parameters used by the implicit solver routines. The condenser (i.e., the first heat exchanger 26) can be modeled by dividing the total volume of the condenser into N discrete elements along its length and using a finite-difference method. Condenser heat rejection $\dot{Q}_c$ can be determined using the following equation:

$$\dot{Q}_c=\Sigma_{i=1}^{N}\in_c C_{pc}(T_{ci}-T_a),$$

where $\in_c$ is condenser effectiveness, $C_{pc}$ is condenser heat capacity, $T_a$ is ambient air temperature, and $T_{ci}$ is the working fluid temperature in the $i^{th}$ element of the condenser. Appropriate models for the heat transfer correlations may be implemented that depend on the flow rate $\dot{V}_a$ of air forced over the condenser by the fan 27, condenser fin material, and condenser fin geometry (e.g., smooth, corrugated, wavy and louvered). Refrigerant properties within the condenser may be governed by a conservation of refrigerant mass and energy along with pressure drop due to friction. These equations may be integrated to remove the spatial dependence, resulting in a lumped-parameter time-based ordinary differential equation.

Block 235 represents a model of the second heat exchanger 28 (i.e., the liquid-line/suction-line heat exchanger) used by the implicit solver routines. The heat flow rate $\dot{Q}_s$ may be determined between the compressor suction line (i.e., the second coil 40 of the second heat exchanger 28) and the condenser liquid line (i.e., the first coil 36 of the second heat exchanger 28) at a temperature Tel of the working fluid within the condenser liquid line. The heat flow rate Os may be determined using the following equation:

$$\dot{Q}_S=h_S l_S d_S(T_{cs}-T_{cl}),$$

where $T_{cs}$ is a temperature of the working fluid within the compressor suction line (i.e., the second coil 40), $T_{cl}$ is a temperature of the working fluid within the condenser liquid line (i.e., the first coil 36), $h_s$ is an appropriate heat transfer coefficient for the second heat exchanger 28, $L_s$ is an effective length over which the first and second coils 36, 40 are in a heat transfer relationship with each other, and $D_s$ is an effective tube size (e.g., diameter) of the coils 36, 40.

Block 240 represents equations for expansion device parameters used by the implicit solver routines. The expansion device 30 restricts flow and creates a pressure differential between the evaporator and the condenser. Therefore, a mass flow rate $\dot{m}_v$ through the expansion device 30 can be determined using the following equation:

$$\dot{m}_v=A_v\sqrt{2\rho_v(p_c-p_e)},$$

where $p_v$ is a density of the working fluid through the expansion device 30, $p_c$ is condenser pressure, $p_e$ is evaporator pressure, and $A_v$ is the effective flow area (throttling area) through the expansion device 30.

The effective flow area $A_v$ through the expansion device 30 is fixed for orifice and capillary tube expansion devices. For thermal expansion valves and electronic expansion valves, a mechanical or electrical feedback system changes the effective flow area $A_v$ to maintain a predetermined evaporator superheat. The effective flow area $A_v$ can be determined based on the feedback gain $G_v$ and time constant $\tau_v$ of the expansion device 30 according to the following equation:

$$A_v=A_{nom}+G_v[(T_b-T_e)-\Delta T_{sh}],$$

where $T_b$ is a thermal sensing element (e.g., a thermo-bulb) temperature, $\Delta T_{sh}$ is the evaporator superheat (i.e., a difference between the saturated evaporator temperature and a temperature of working fluid exiting the evaporator), and $A_{nom}$ is nominal flow area of the expansion device 30 (which can be input by the user). Since the feedback for a thermal expansion valve is mechanical (i.e., a temperature response for the thermal sensing element), the response lag can be modeled by the following equation:

$$dT_b/dt=(T_b-T_{ev})/\tau_v,$$

where $T_{ev}$ is a temperature of working fluid exiting the evaporator.

Blocks 245, 250 and 255 represent equations including water-side and refrigerant-side evaporator parameters and ice-formation parameters used by the implicit solver routines. The refrigerant side of the evaporator can be modeled in a similar manner as the refrigerant side of the condenser, i.e., by dividing the total volume of the evaporator into N discrete elements along its length and using a finite-difference method. Evaporator heat rejection $\dot{Q}_e$ can be determined using the following equation:

$$\dot{Q}_e=\Sigma_{i=1}^{N}\in_e C_{pe}(T_g-T_{ei}),$$

where $\in_e$ is evaporator effectiveness, $C_{pe}$ is evaporator heat capacity, $T_g$ is a temperature of the ice tray 58, and $T_{ei}$ is the working fluid temperature in the $i^{th}$ element of the evaporator.

Heat transfer from ice in the ice tray 58 and heat transfer into the evaporator includes heat transfer through liquid water, ice, the ice tray 58 and refrigerant. The heat flow from the ice tray 58 to the ice may be determined using the following equation:

$$\dot{Q}_I=kA_e(T_I-T_g)/s+h_wA_e(T_w-T_I),$$

where k is the thermal conductivity of ice, $A_e$ is the surface area of the ice tray 58 in contact with the water and ice, s is the thickness of the ice, $h_w$ is the convection coefficient for a flowing liquid over a plate, $T_w$ is a temperature of the water, and $T_I$ is a temperature of the ice. Thickness of the ice (s) is zero at the start of the freeze cycle and can be considered proportional to the cumulative evaporator heat transfer given by $\Sigma\dot{Q}_e\Delta t$.

At block 260, the simulation module 14 determines whether there is convergence at the nodes (i.e., whether the through-variables (e.g., mass flow rate and heat flow rate) sum to zero at the nodes and the across-variables (e.g., pressure and enthalpy) at the nodes are equal). The simulation module 14 runs the implicit routines using the implicit solver system to solve sets of the above equations (e.g., the equations described above with respect to blocks 220-255) as needed until there is convergence at the nodes (i.e., Kirchhoff's first and second laws are satisfied at the nodes).

Once the sets of equations are solved for convergence at the nodes, the simulation module 14 loops back to block 210, where time (t) is incremented by a predetermined step. Thereafter, the freeze model 200 is repeated until the simulation module 14 determines at block 215 that the predetermined amount of ice has formed. Once the predetermined amount of ice has formed, the simulation module 14 switches to the harvest model 300 to model operation of the ice maker 10 in the harvest mode.

Referring now to FIG. 5, general steps of the harvest model 300 will be described. At block 305, the simulation module 14 increments through time (e.g., time during which the vapor-compression system 20 is operating in the harvest mode).

At block 310, the simulation module 14 determines whether a specified amount of ice in the ice tray 58 has melted (e.g., based on elapsed time, evaporator temperature, etc.). If the specified amount of ice has melted, then the simulation module 14 switches back to the freeze model 200. If the specified amount of ice has not melted, then the simulation module 14 proceeds to determine various system parameters (at blocks 315-335) using the implicit routines of the implicit solver system to solve sets of overall algebraic and differential equations as needed to satisfy Kirchhoff's first and second laws at the nodes.

Block 315 represents equations for compressor parameters used by the implicit solver routines. These equations may include the equations described above with respect to block 220.

Block 320 represents equations used by the implicit solver routines that include parameters of the bypass control valve 48. As described above, during the harvest mode, the bypass control valve 48 is open to allow the refrigerant to bypass the first and second heat exchangers 26, 28 and the expansion device 30, and instead, flow directly to the third heat exchanger 32 (the evaporator). A mass flow rate $\dot{m}h$ of refrigerant through the bypass control valve 48 can be determined using the following equation:

$$\dot{m}_h = A_h\sqrt{2\rho_d(p_d - p_e)},$$

where $\rho_d$ is a density of the refrigerant that is discharged from the compressor 24, $p_d$ is the pressure of the refrigerant that is discharged from the compressor 24, $p_e$ is evaporator pressure, and $A_h$ is the effective flow area (throttling area) through the bypass control valve 48.

Blocks 325-335 represent equations for compressor parameters used by the implicit solver routines. These equations may include the equations described above with respect to block 220.

Blocks 325, 330 and 335 represent equations used by the implicit solver routines that model evaporator parameters and heat added to the ice during the harvest mode. These equations may include the equations described above with respect to blocks 245, 250, 255.

At block 340, the simulation module 14 determines whether there is convergence at the nodes (i.e., whether the through-variables (e.g., mass flow rate and heat flow rate) sum to zero at the nodes and the across-variables (e.g., pressure and enthalpy) at the nodes are equal). The simulation module 14 runs the implicit routines using the implicit solver system to solve sets of the above equations (e.g., the equations described above with respect to blocks 315-335) as needed until there is convergence at the nodes (i.e., Kirchhoff's first and second laws are satisfied at the nodes).

Once the sets of equations are solved for convergence at the nodes, the simulation module 14 loops back to block 305, where time (t) is incremented by a predetermined step. Thereafter, the harvest model 300 is repeated until the simulation module 14 determines at block 310 that the predetermined amount of ice has melted. Once the predetermined amount of ice has melted, the simulation module 14 resets to the ice mass to zero at block 345 (i.e., the ice is ejected from the ice tray 58 once the predetermined amount of ice melts) and then switches back to the freeze model 200 to model another operation cycle of the ice maker 10 in the freeze mode.

The above process of modeling the freeze and harvest modes using the freeze and harvest models 200, 300 may be repeated for a predetermined number of cycles. The simulation module 14 may calculate the total energy consumption of the ice maker 10 and the total amount (e.g., mass) of ice produced by the ice maker 10 during the predetermined number of cycles and/or energy consumption and amount of ice produced per cycle. The energy consumption and ice production data may be communicated to the output interface 16, which can display and/or print this data for the user. Additionally, the simulation module 14 can determine a total freeze time and a total harvest time for the predetermined number of cycles and/or freeze time and harvest time per cycle, and communicate that data to the output interface 16 for the user to view.

After running the simulation model through the predetermined number of cycles, the user of the simulation model can then change one or more of the input parameters (e.g., the parameters input by the user at blocks 110, 120, 130) and run the simulation model again for the predetermined number of cycles. In this manner, the user can compare the simulation results to evaluate whether and how the user's parameter change(s) benefited or hindered the performance of the ice maker 10. This process can be repeated any number of times to assist the user in designing a more energy efficient and/or more productive ice maker.

Results from the simulation model described above were compared with data measured during operation of a fully instrumented 500 pound capacity ice maker. The simulation results and measured data include (1) cycle time (i.e., duration of freeze and harvest cycles), (2) energy input per 100 pounds of ice, and (3) energy usage during 24 hours of operation. The simulation results were accurate to within 5% of the actual measured data.

As described above, the simulation model of the present disclosure allows ice maker designers and engineers to quickly evaluate the impact of a variety of system design options including, for example, heat exchanger size, size and shape of finned surfaces, air flow rate, water flow rate, ambient air temperature, inlet water temperature, compressor capacity and/or efficiency, refrigerants, suction-line heat exchanger properties, and/or expansion valve properties.

The implicit solver system (such as SimScape, Simulink®, Modelica®, LabVIEW, etc.) of the simulation model 14 uses acausal modeling and does not utilize a predetermined calculation procedure to solve the sets of the above equations. Rather, the steps for solving the sets of equations for convergence at the nodes may be determined on a case-by-case basis.

The implicit solver may determine values for all of the system variables that satisfy the model equations based on the user-supplied initial conditions. The user-supplied values specified during the initialization steps may not be the actual values of the respective variables, but rather their target values at the beginning of the simulation (time=0). Depending on the results of the solve, some of the targets may or may not be satisfied.

After computing the initial conditions, or after a subsequent event (e.g., a discontinuity resulting from a bypass valve opening, for example), the implicit solver performs a transient initialization. The transient initialization may fix dynamic variables and solves for algebraic variables and derivatives of dynamic variables. The goal of the transient initialization is to provide a consistent set of initial conditions for the transient solve phase (e.g., the phase in which the implicit solver solves the equations). In the transient solve phase, continuous differential equations are integrated in time to compute the variables as a function of time. The implicit solver continues to perform the simulation according to the results of the transient solve until the solver encounters an event, such as an ice harvest. If the solver encounters an event, the solver returns to the phase of the transient initialization, and then back to the transient solve phase. The cycle continues until the end of the simulation.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term 'module' or the term 'controller' may be replaced with the term 'circuit.' The term 'module' may refer to, be part of, or include processor hardware (shared, dedicated, or group) that executes code and memory hardware (shared, dedicated, or group) that stores code executed by the processor hardware.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. Shared processor hardware encompasses a single microprocessor that executes some or all code from multiple modules. Group processor hardware encompasses a microprocessor that, in combination with additional microprocessors, executes some or all code from one or more modules. References to multiple microprocessors encompass multiple microprocessors on discrete dies, multiple microprocessors on a single die, multiple cores of a single microprocessor, multiple threads of a single microprocessor, or a combination of the above.

Shared memory hardware encompasses a single memory device that stores some or all code from multiple modules. Group memory hardware encompasses a memory device that, in combination with other memory devices, stores some or all code from one or more modules.

The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of a non-transitory computer-readable medium are nonvolatile memory devices (such as a flash memory device, an erasable programmable read-only memory device, or a mask read-only memory device), volatile memory devices (such as a static random access memory device or a dynamic random access memory device), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

What is claimed is:

1. A method comprising:

selecting, at a processor, a first set of values for a first set of parameters of one or more hardware components of an ice-making machine, wherein the ice-making machine is configured to, in a freeze mode, cool liquid water using an evaporator to exchange heat with the liquid water;

identifying, at the processor, a water temperature at a water inlet of the ice-making machine;

identifying, at the processor, an ambient air temperature surrounding the ice-making machine;

executing, by the processor, a model of the freeze mode of the ice-making machine, wherein executing the model of the freeze mode includes:

determining, by the processor, whether a predetermined amount of liquid water in a receptacle of the ice-making machine is frozen and in response to a determination that the predetermined amount of liquid water in the receptacle of the ice-making machine is not frozen, calculating, by the processor, a second set of parameters of the ice-making machine based on at least a portion of the first set of values, the water temperature and the ambient temperature, the second set of parameters corresponding to operation of the ice-making machine in the freeze mode in which the liquid water is cooled by the evaporator, wherein the calculation of the second set of parameters is repeated until the predetermined amount of liquid water in the receptacle of the ice-making machine is frozen; and in response to a determination that the predetermined amount of liquid water in the receptacle of the ice-making machine is frozen, executing, by the processor, a model of a harvest mode of the ice-making machine, wherein executing the model of the harvest mode includes:

determining, by the processor, whether a predetermined amount of ice in the receptacle of the ice-making machine is melted and in response to a determination that the predetermined amount of ice in the receptacle of the ice-making machine is not melted, calculating, by the processor, a third set of parameters of the ice-making machine based on at least a portion of the first set of values, the water temperature and the ambient temperature, the third set of parameters corresponding to operation of the ice-making machine in the harvest mode during which the predetermined amount of ice is melted until the ice is removed from the evaporator, wherein the first set of parameters includes compressor motor speed, an initial evaporator pressure at a startup of the ice-making machine and an initial condenser pressure at the startup of the ice-making machine.

2. The method of claim 1, further comprising:

selecting, at the processor, a second set of values for the first set of parameters of the one or more hardware components;

calculating, by the processor, the second set of parameters of the ice-making machine based on at least a portion of the second set of values;

calculating, by the processor, the third set of parameters of the ice-making machine based on at least a portion of the second set of values; and comparing results of the calculations of the second and third sets of parameters based on the first values with the results of the calculations of the second and third sets of parameters based on the second values.

3. The method of claim 2, wherein the results include energy consumption of the ice-making machine and ice production of the ice-making machine.

4. The method of claim 3, further comprising designing a vapor-compression system based on the comparison of the results.

5. The method of claim 4, wherein designing the vapor-compression system includes selecting a compressor based on the comparison of the results.

6. The method of claim 1, wherein the first set of parameters includes one or more of a compressor capacity, compressor efficiency, geometric parameters of a condenser and the evaporator, and/or an air flow rate of a condenser fan.

7. The method of claim 1, further comprising displaying, by the processor, values of the second and third sets of parameters.

8. The method of claim 1, wherein the second and third sets of parameters include energy consumption of the ice-making machine and ice production of the ice-making machine.

9. The method of claim 1, wherein the second set of parameters includes heat transfer between first and second conduits of a heat exchanger, the first conduit containing condensed refrigerant upstream of an expansion device, the second conduit receiving refrigerant downstream of the evaporator and upstream of a suction inlet of a compressor.

10. The method of claim 1, wherein the second set of parameters includes a flow area of an expansion device.

11. The method of claim 1, wherein the third set of parameters includes a flow area of a bypass control valve.

12. The method of claim 1, wherein calculating the second and third sets of parameters includes using, by the processor, an implicit solver to solve sets of equations to satisfy Kirchhoff's first and second laws at nodes of a vapor-compression system of the ice-making machine.

* * * * *